US006318227B1

(12) United States Patent
Scherzinger

(10) Patent No.: US 6,318,227 B1
(45) Date of Patent: Nov. 20, 2001

(54) CIRCULAR BRAIDING MACHINE AND STRAND GUIDING DEVICE FOR SAME

(75) Inventor: Werner Scherzinger, Bisingen (DE)

(73) Assignee: Sipra Patententwicklungs- U. Beteiligungsgesellschaft mbH (DE)

( * ) Notice: Subject to any disclaimer, the term of this patent is extended or adjusted under 35 U.S.C. 154(b) by 0 days.

(21) Appl. No.: 09/444,750

(22) Filed: Nov. 22, 1999

(30) Foreign Application Priority Data

Nov. 23, 1998 (DE) ..... 198 53 869

(51) Int. Cl.[7] ..... D04C 3/24

(52) U.S. Cl. ..... 87/44; 87/14; 87/15; 87/18; 87/20; 87/31; 87/33; 87/43; 87/49; 87/55; 87/56

(58) Field of Search ..... 87/14, 15, 18, 87/20, 31, 33, 43, 44, 49, 55, 56

(56) References Cited

U.S. PATENT DOCUMENTS 4,535,674 * 8/1985 Bull et al. ..... 87/29
5,457,967 * 10/1995 Scherzinger ..... 66/151
5,749,280 * 5/1998 Scherzinger ..... 87/48
5,787,784 * 8/1998 Scherzinger ..... 87/44

FOREIGN PATENT DOCUMENTS 44 22 893 A1 1/1996 (DE) .
4422893-A1 * 1/1996 (DE) .
195 47 930 A1 6/1997 (DE) .
19547930-A1 * 6/1997 (DE) .

* cited by examiner

*Primary Examiner*—John J. Calvert
*Assistant Examiner*—Shaun R Hurley
(74) *Attorney, Agent, or Firm*—Michael J. Striker

(57) ABSTRACT

The strand guiding device is designed for a circular braiding machine having a braiding point (35) and a first spool (38) for a first strand (37) fed to said braiding point (35). The strand guiding device for strand guiding includes a guide part or guide device (42) for the first strand arranged between the first spool (38) and the braiding point (35), which is movable back and forth to cross the first strand (37) over at least one second strand (32) coming from a respective second spool (31) so that a length of a section of the first strand (37) between the first spool and the braiding point (35) continuously changes, and a device for compensating changes in the length of that section. The device for compensating includes at least one movable guide element (76) for the first strand (37) arranged between the first spool (38) and the guide part or guide device (42) and a positive guiding device (63,67) for moving the at least one movable guide element (76), whereby the length changes are at least partially compensated by motions of the at least one movable guide element. A circular braiding machine is also described which is equipped with this type of strand length change compensating device.

12 Claims, 6 Drawing Sheets

CIRCULAR BRAIDING MACHINE AND STRAND GUIDING DEVICE FOR SAME

BACKGROUND OF THE INVENTION

1. Field of the Invention

The present invention relates to a circular braiding machine for braiding strands and, more particularly, to a circular braiding machine with a rotation axis, the circular braiding machine comprising a group of inner spools and another group of outer spools, each spool carrying a single strand, and each group arranged on a respective circular track coaxial to the rotation axis and movable in opposite directions and means for crossing the strands of the inner and outer spools. It also relates to a device for strand guiding in this circular braiding machine comprising a strand guide part or guide device arranged between a first spool and a braiding point for a strand fed to the braiding point from the first spool, which is movable back and forth for crossing the first strand over at least one second strand coming from a second spool so that the length of a section of the first strand between the first spool and the crossing point continuously changes, and a device for compensating these length changes having at least one movable guide element for the first strand arranged between the first spool and the guide part or guide device.

2. Prior Art

In the known circular braiding machine of this type, for example as described in German Patent Documents DE 44 22 893 A1 and DE 195 47 930 A1, the strands of material being braided coming from the outer and inner spools are guided with guide devices to the braiding point, which are movable back and forth inclined to the rotation axis in order to cause crossing of the concerned strand according to the rapid braiding principle with the strands coming from the outer and inner spools. The motion of the guide devices occurs, among other reasons, with the help of crank elements and push rods so that the guide devices or parts execute an essentially sinusoidal motion about the rotation axis of the circular braiding machine, however they accelerate in the region of the crossing point and are delayed at the turning point regions in order to avoid whip-like back and forth motions.

The motion of the guide devices or parts has the result that the length of the strand sections located between the outer spools and the braiding point continuously changes during operation. Thus a compensation device must be provided for each outer spool, which temporarily stores an excess strand portion and delivers this strand portion on demand in order to avoid sagging or tearing of the strands. A compensation device of this type usually comprises pivoting plates acted on by spring forces and rollers attached to them that must be in a position to compensate for length changes of up to about 50 mm. This has the disadvantage that somewhat expensive springs are necessary which have a constant characteristic curve over the entire compensation range. This is not always attainable and a variation of the tension within the above-described strand section occurs as a result. Furthermore this type of compensation device has a certain inertia because of the masses being moved, which can lead to tearing of the strands or the threads or filaments forming them at high rotation speed.

SUMMARY OF THE INVENTION

It is an object of the present invention to provide a strand guiding device of the above-described kind for a circular braiding machine, in which the greater part of the compensation for length changes is obtained with other means than springs.

It is another object of the present invention to provide a circular braiding machine for braiding strands including this strand guiding device with the means for compensation of strand length changes according to the invention.

These objects, and others which will be made more apparent hereinafter, are attained in a strand guiding device in this circular braiding machine, this device for strand guiding comprising a guide part or guide device for a first strand arranged between a first spool and a braiding point for a strand fed to the braiding point from the first spool, which is movable back and forth for crossing the first strand over at least one second strand coming from a second spool so that the length of a section of the first strand between the first spool and the braiding point continuously changes, and a device for compensating these length changes having at least one movable guide element for the first strand arranged between the first spool and the guide part or guide device.

According to the invention the compensation device includes a positive guidance means for moving the at least one movable guide element, whereby the length changes of the first strand are at least partially compensated by the motion of the at least one movable guide element.

According to the invention the circular braiding machine has a rotation axis and comprises

- a group of inner spools and another group of outer spools, each spool carrying a single strand, and each group being arranged on a respective circular track coaxial to the rotation axis and movable in opposite rotation directions;
- means for crossing the strands of the inner and outer spools, wherein the means for crossing the strands includes guide parts or devices for guiding the respective strands from one groups of the spools to a point between the spools of that group and a braiding point, whereby the guide parts or devices are movable back and forth so that respective lengths of the strand sections between the braiding point and the spools of the one group continuously change; and
- means for compensating for the changes in the lengths of the strand sections including at least one movable guide element for the strands arranged between each spool of the one group and the guide element associated therewith and a positive guidance means for moving the at least one movable guide element so that the length changes of the first strand are at least partially compensated by motion of the at least one movable guide element for the strands.

Preferred embodiments of the invention are claimed in the appended dependent claims.

The invention is based on the surprising understanding that it is possible to compensate for about 75 percent or more of the strand length changes due to controlled motion along a path with a positive guidance of the movable conducting members for the strands, which can be simply performed and adjusted to the individual embodiment. The remaining compensation motions performed by springs are negligibly small in regard to their inertia and danger of breaking and may be performed with springs which are provided with constant characteristic curves only over a short spring displacement range.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
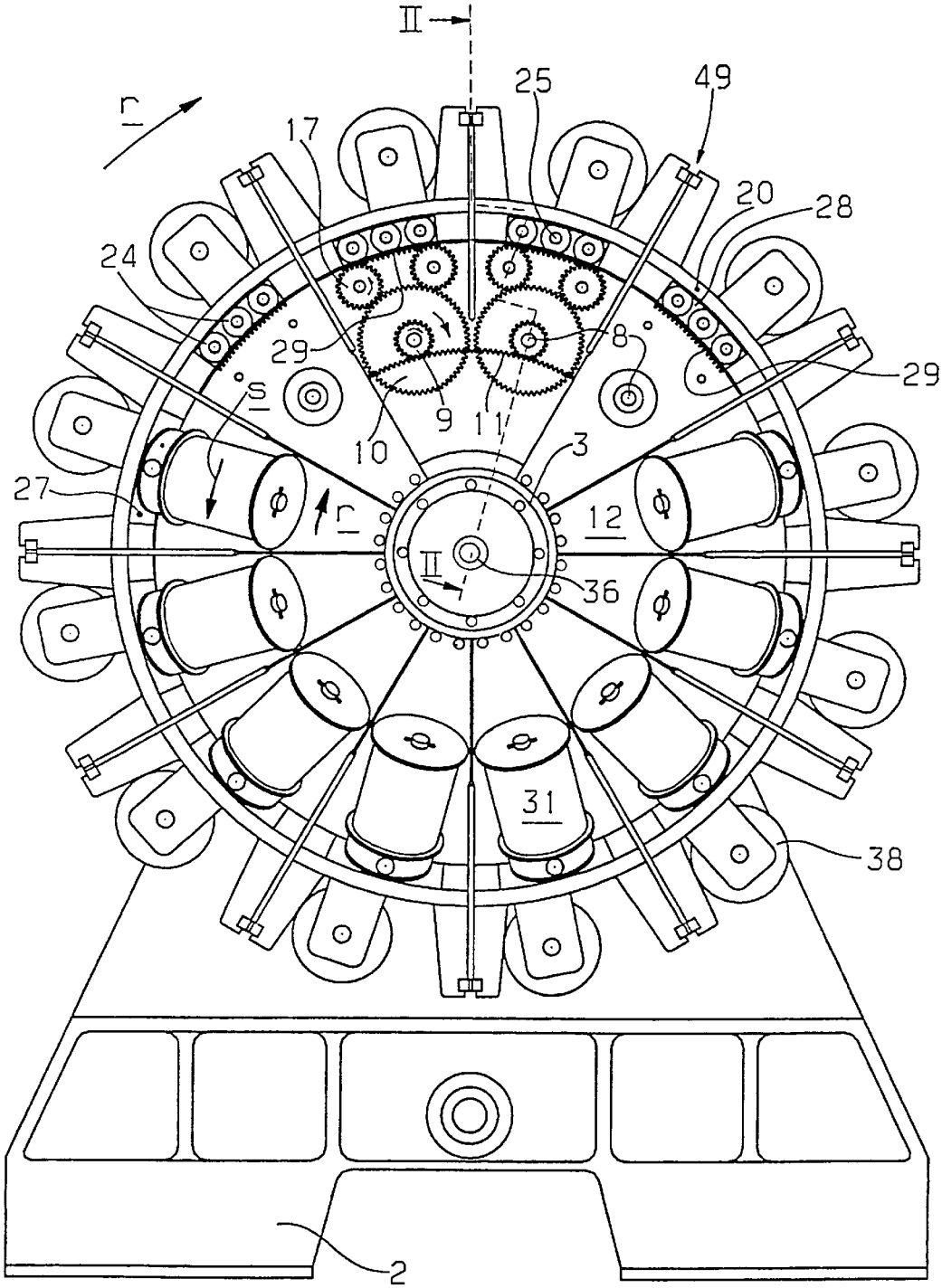
FIG. 1 is a partially cutaway front view of a circular braiding machine of the relevant art.
Figure 2:
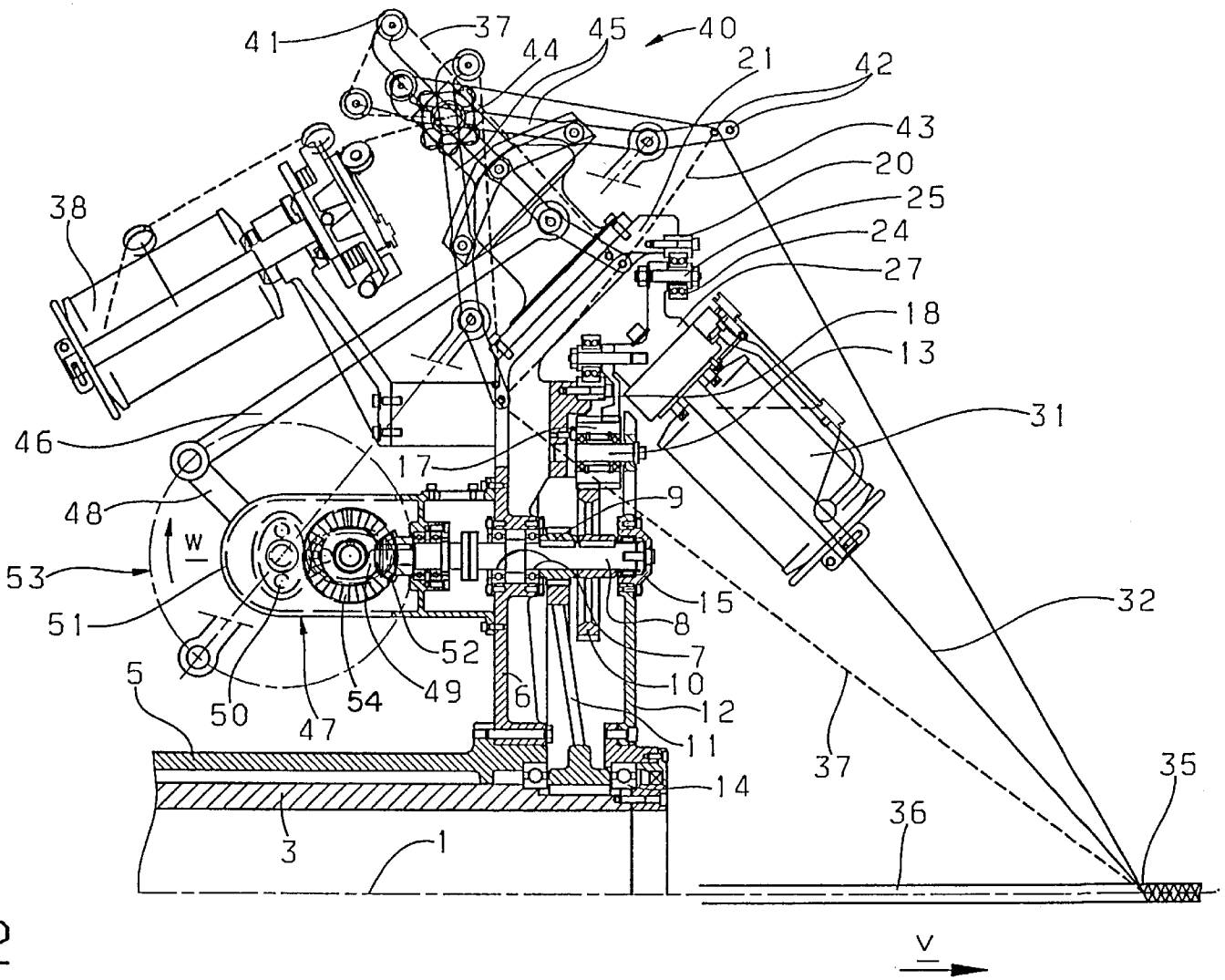
FIG. 2 is a vertical cross-sectional view taken approximately along the line II—II in FIG. 1 through the upper half of the circular braiding machine according to the invention having the compensating device for strand length changes.

One embodiment of a circular braiding machine with a horizontal rotation axis 1 (FIG. 2) is shown in FIGS. 1 and 2. A rotor support 3 on which a hub 5 is mounted so as to be rotatable about the rotation axis 1 is attached to a base frame 2. The hub 5 supports a substantially circular annular rotor 6 that extends vertically. A plurality of bearing devices 7 are arranged in the annular rotor 6 at a constant distance from the rotation axis 1 and with equal angular spacing around the rotation axis 1. Shafts 8 are rotatably mounted in the respective bearing devices 7 so as to be parallel to the rotation axis 1. First a pinion 9 and then gear wheel 10 are successively attached to each of these shafts 8 on the front side of the rotor. Each pinion 9 is engaged with a gear 11, which is arranged in front of the rotor 6 coaxial to the rotation axis 1 and stationary. When the rotor 6 is rotated this pinion 9 revolves like a planetary gear on the gear 11 operating as the sun wheel.

The rotor 6 furthermore carries a substantially circular support 12 arranged in front of the gear wheels 10, which is attached to the rotor 6 by means of pins 13 radially exterior to the shafts 8 and parallel to them. The circular support 12 is also rotatably mounted on the rotor support 3 by means for bearing device 14. The circular support 12 is supported by means of additional bearing devices 15 on the front ends of the shafts 8. Intermediate pinions 17 that are engaged with the gear wheels 10 are rotatably mounted on the pins 13 between the circular support 12 and the rotor 6. As shown in FIG. 1, twelve shafts 8 and gear wheels 10 are arranged around the rotation axis 1 in this embodiment. Two intermediate pinions 17 are associated with each gear wheel 10. The pins 13 of the intermediate pinions 17 are arranged in a circle coaxial to the rotation axis 1.

Segments 18 in which radially exterior, i.e. upwardly open in FIG. 2, groove-like roller tracks are provided are attached to the circular support 12 and equally spaced around the outer circumference of the circular support 12. Corresponding segments 20 are attached to the rotor 6 by means of supporting piece 21. Radially interior, i.e. downwardly open in FIG. 2, groove-like roller tracks are worked into the segments 20. Furthermore the segments 20 are arranged axially in front of the segments 18 and are spaced further from the rotation axis than the segments 18.

The roller tracks of the segments 18,20 receive rollers 24 (FIG. 1), which are rotatably mounted on bearing pins 25 axially parallel to the rotation axis 1. These bearing pins 25 are attached to the spool carriers 27, which like the segments 18, 20 are uniformly distributed around the rotation axis 1. Furthermore circular arc sections 28 with inner teeth 29 that mesh with the intermediate pinions 17 are attached to the bearing pins 25. The circular arc sections 28 have respective lengths, as viewed in the circumferential direction of the rotor 6, so that each circular arc section 28 is engaged with at least one of the intermediate pinions 17 independently of its instantaneous position during rotation of the rotor. However radial free spaces or slots are present between the individual circular sections 28. The rollers 24 are correspondingly mounted on the spool carriers 27 so that each spool carrier 27 is continuously guided independently of its momentary position with at least two rollers 24 in each segment 18,20 during relation rotation of the rotor 6. However radial slots or free spaces are arranged between the individual spool carriers. Both the roller tracks of the segments 18,20 and the teeth 29 are arranged in circles that are coaxial to the rotation axis 1.

The spool carriers 27 carry a first group of front or inner spools 31. A strand 32 or filament (wire) is guided from each of the spools 31 to a braiding point 35 and braided around a braid material 26 transported in the direction of the rotation axis 1 (arrow v in FIG. 2) and coaxial to it.

Additional filaments or strands 37 are supplied from a second group of rear or outer spools 38, which are attached to the rotor 6 by means of retaining elements 39 and supporting piece 21, and which are guided to the braiding point 35 by the device 40 according to the invention. For example, twelve front and/or rear spools 31 and/or 38 are provided in the embodiment according to FIG. 1.

The drive of the circular braiding machine occurs by means of an unshown drive motor mounted in the base frame 2, which drives a drive gear by means of a transmission or gear device which meshes with the gear wheels attached to the hub 5.

When the drive motor is turned on, the hub 5 and the rotor 6, the circular support 12, the segments 18 and 20 and the rear spools 38 are rotated in a predetermined direction, e.g. clockwise, as shown in FIG. 1 by the arrow r. Because of that the pinions 9 roll on the periphery of the gears 11, so that both they and the gear wheels 10 are rotated in the clockwise direction. In contrast, the intermediate pinions 17 are driven in a counterclockwise direction. Because of the appropriate dimensioning of the different gear wheels or pinions rotation of the intermediate pinions occurs at a rotation speed that is high enough so that the spool carriers 27 or the inner teeth 29 in engagement with them and the front spools 31 with them are moved in the roller tracks of the segments 18,20 in a counterclockwise direction (arrow s in FIG. 1), and of course with the same, but opposite, angular rotation speed as the rotor 6.

So that the crossing strands 32,37 are wound around the braided material 36 in the manner characteristic for braiding, the strands of one group of spools must be periodically moved between the spools of the other group. Usually the strands 37 of the rear spools 38 are moved between the front spools 31, so that sufficiently large radial slots or free space must be present between the front spools 31 and also between the parts supporting them during the cross-over motion, which are provided in the embodiment, e.g., between the segments 18,20 and the spool carriers 27, and also between the support piece 21 or in rotor 6 and, if necessary, in the circular support 12.

In the illustrated embodiment the strands 37 of the rear spools 38 are moved periodically between the front spools 31 with the help of mechanism 40. The strands 37 from each spool 38 are each first fed to a respective guide roller 41 and from there to a braiding point 35 through a respective guide part 42, e.g. an eye. Each guide part 42 is guided on a gently curved motion path 43 according to FIG. 2 and for this purpose is mounted on a respective pivotable lever 45 pivotally mounted at 44, which is movable by means of an associated push rod 46, which is articulated to a respective crank element driven by a respective gear unit 47.

As shown in FIG. 2, each curved motion path 43 is arranged with radial spacing from the rotation axis and preferably substantially in a common plane with it, whereby the extension of its axes preferably forms an acute angle with the rotation axis 1. The axes of the motion paths 43 of all guide parts 42 lie on a rotation cone with the rotation axis 1 as rotation axis.

Furthermore it is essential that the respective push rod 46 should be located substantially at the extension of the motion path 43 at both turning points of the associated guide parts 42, i.e. when they reach the ends of the motion path 43. Because of that each push rod 46 is acted on by a pulling or pushing force, but not a bending force, at the turning points, so that no excessive oscillations or vibrations can occur, as is unavoidable in the known circular braiding machines because of the whipping effects. Thus also the end of the push rod remote from the guide parts 42 is not moved back and forth at any point in time, but guided by means of the crank element 48 on the circular path 53 in the direction of the arrow w according to FIG. 2, whereby mechanical stresses and strains in the entire stand guiding system are largely avoided at high operating speeds.

The gear unit 47 can be formed in different ways and is preferably designed so that the speed of each strand guide part 42 is smaller at the ends of the motion path 43 and larger in the middle portion of the motion path 43, than it should be in the case of a pure sinusoidal motion. Each gear unit 47 is, e.g., an eccentric or a sum gear unit or, as in this embodiment, an oval wheel gear unit, which has drive and driven oval gear wheels 49, 50 that are engaged with each other. According to FIG. 2 each gear unit 47 includes a gear housing 51, which is attached to the rotor 6 and also has a drive pinion 52 in the form of a bevel gear shown in FIG. 2, that is attached to the end of the respective shaft 8 furthest from the associated bearing element 15. The drive pinion 52 drives another bevel gear 54. It is mounted on a first shaft rotatably mounted in the gear housing 51, The drive oval gear wheel 49 is attached to the first shaft. A second shaft is rotatably mounted in the gear housing 51 parallel to the first shaft and the driven oval gear wheel 50 and the crank element 48 are attached to the second shaft.

Circular braiding machines of this type are generally known to one skilled in the art and are not described in further detail here. The contents of above-mentioned German Patent Documents DE 44 22 893 A1 and DE 195 47 930 A1 are hereby referred to for further details regarding the structure of circular braiding machines and are incorporated here by reference.

FIGS. 3 to 6 show details of the means or device 40 for strand guidance according to the invention. The means or device 40 includes a carrier 56, which is attached with screws 57 and one of the associated supporting pieces 21 to the rotor 6 (FIG. 2) and has bearing 58 (FIG. 4) on its upper end, with which an axle 59 is rotatably mounted in the carrier 56. The carrier 56 is held thereby between a shoulder 60 that is formed on the front side of the axle 59 and a head of a screw 61 that is rotated into the axle 59 on the rear side of the carrier 56. On the side of the shoulder 60 the axle 59 moreover has a, e.g., square side plate 62, which forms a part of the pivot head 63 together with the axle 59. This square side plate 62 acts to mount the pivotable lever 45 seen in FIG. 2. The location of the axle 59 corresponds to the position 44 in FIG. 2.

The pivotable lever 45 comprises e.g. a flat longitudinally extended body which is provided with two guide rollers 64 on its lower end, which are arranged with slight spacing from each other and which together form the guide part 42 for the strand 37 according to FIG. 2. The pivotable lever 45 has a following element 66 located on its rear side in a central section, which is e.g. a rotatably mounted roller and which cooperates with a guide track 67, which is formed by a guide groove receiving the roller, which is provided in a front side of a curved track holder 67*a* attached to the carrier 56.

Figure 3:
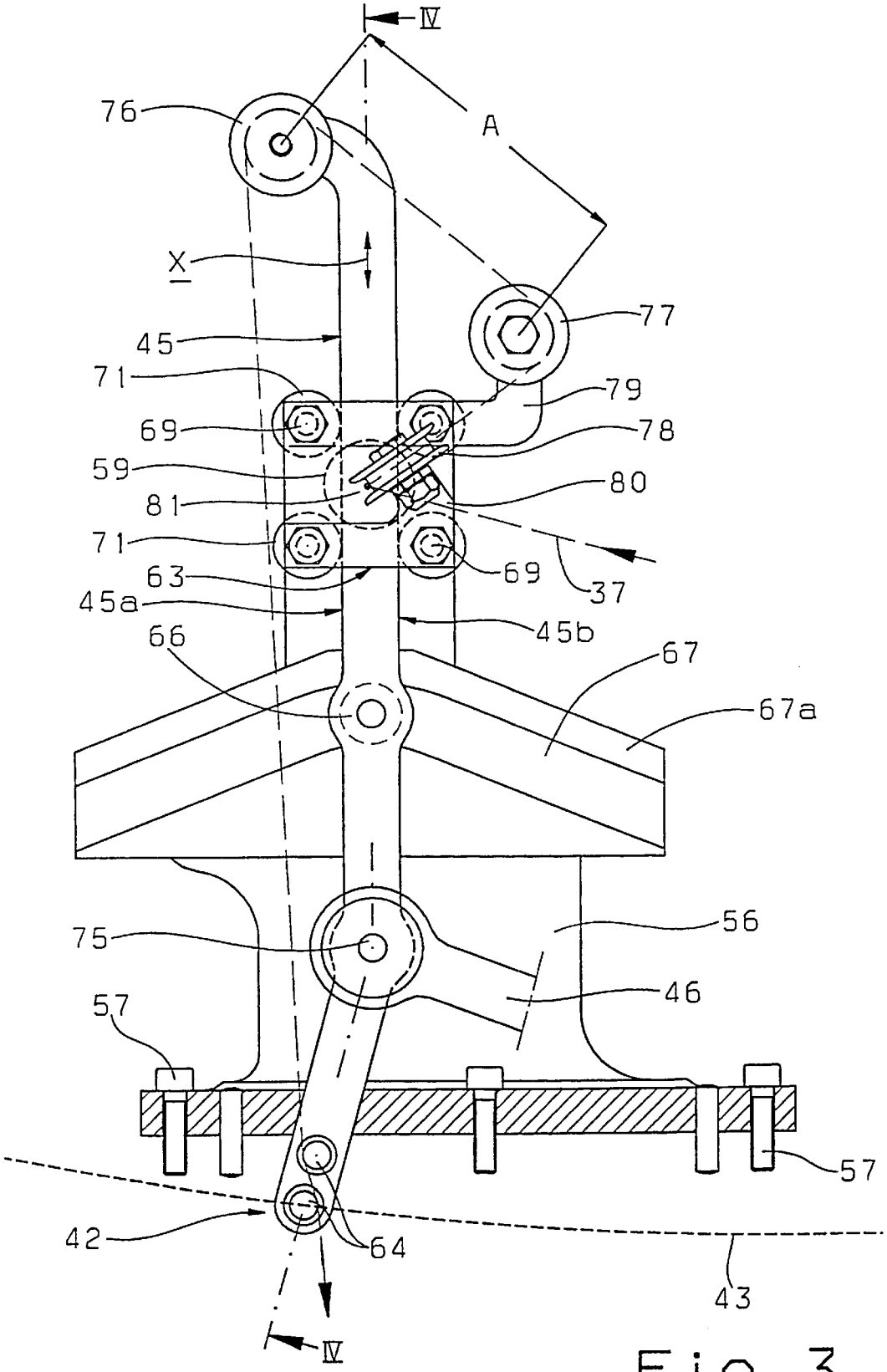
FIG. 3 is a detailed front view of the compensating device according to the invention in a middle operating position.
Figure 4:
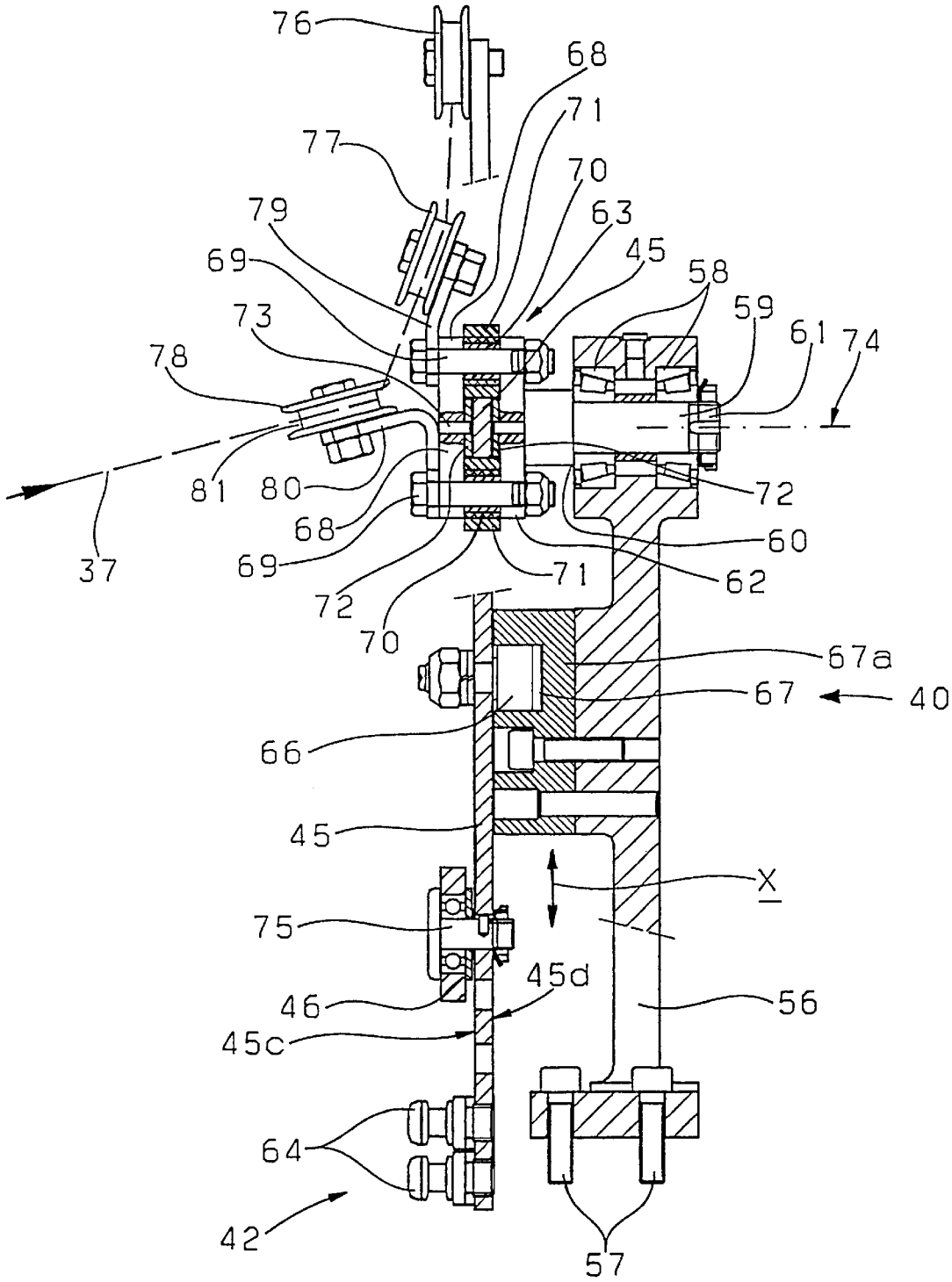
FIG. 4 is a longitudinal cross-sectional view through the compensating device of FIG. 3 taken along the section line IV—IV of FIG. 3.

The pivotable lever 45 is pivotably and slidably mounted in the pivot head 63. The pivot head 63 has a second side plate 68 arranged with spacing from it parallel to the first square side plate 62. Both side plates 62,68 are connected by four screws 69 (see especially FIG. 3) and are held spaced from each other. Bearing sleeves 70 are arranged between the side plates 62,68. Pivot head guiding rollers 71 are rotatably mounted on the bearing sleeves 70. As FIG. 3 shows the pivot head guiding rollers 71 are arranged pairwise with spacing, which corresponds exactly to the spacing of two parallel and preferably straight side edges 45*a*, 45*b* of the pivotable lever 45, so that the pivot head 63 can be slidable or movable back and forth between each upper and lower pair of guide rollers 71, as shown in FIG. 3. Thus the pivot head 63 in FIG. 4 is shown in a position rotated about 90° relative to that in FIG. 3, i.e. the pivotable lever 45 is shown movable in a direction perpendicular to the drawing plane instead of parallel to it in the direction of the double arrow x. Because of that its guide motion between the guide rollers 71 is more easily observable in FIG. 4. Moreover FIG. 4 shows that the pivotable lever 45 is guided with its parallel planar wide sides 45*c*, 45*d* between two slide plates 72, which e.g. are made from brass or steel coated with polytetrafluoroethylene. The slide plates 72 are held e.g. with set pins 73, small set screws or the like, fixed between the square plates 62, 68 and the wide sides 45*c*, 45*d* of the pivotable lever 45. Because of that the pivotable lever 45 is guided, on the one hand, between the guide rollers 71 and, on the other hand, between the slide plates 72. Thus the pivotable lever 45 is thus mounted in the pivot head 63 easily movable in the direction of its longitudinal axis (double arrow x ). The pivotable lever 45 can be simultaneously pivoted with the axle 59 about the pivot axis 74 perpendicular to the arrow x.

In the mounted state the pivotable lever 45 extends through the pivot head 63, while its following element 66 is guided along the guide track 67. At the same time the free end of the push rod 46 (see also FIG. 2) is articulated to the pivotable lever 45 by means of a pivot pin 75 at a position between the guide part 42 and the following element 66. The arrangement is designed so that the push rod 46 is movable back and forth like a connecting rod via the rotating oval gear wheel 50 and rotating crank element 48 and because of that the pivotable lever is movable back and forth about the pivot axis 74 between both extreme positions shown in FIGS. 5 and 6. Thus the pivotable lever 45 simultaneously executes a back and forth motion parallel to its longitudinal axis according to the shape of the guide track 67, whereby the direction of this displacement forms an angle with the vertical direction indicated by the double arrow x in FIG. 4 according to the momentary position of the following element 66 in the guide track 67. The guide part 42 for a strand coming from the outer spool 38 (FIG. 2) is moved back and forth along the concave motion path 43 shown in FIGS. 2 and 3 because of the combined pivot and displacement motions. This means equally that a section of the strand 37 located between the spool 38 and the braid point 35 changes its length continuously. The length change between the end points of the motion path 43 shown in FIGS. 5 and 6, e.g. amounts to 50 mm, whereby the above-described difficulties result which require the conventional compensating devices.

The strand guidance according to the invention is provided by a compensating device according to FIGS. 2 to 4. The compensating device according to the invention has a movable conducting member for the strand 37 located between each spool 38 and the corresponding guide part 42 and means for positively guiding motion of this movable conducting member so that the length changes of the strand is at least partially compensated by the positive guiding motion. For this purpose a guide element 76 formed e.g. as a rotatable guide roller for the strand 37 is arranged on an upper end of the pivotable lever 45 projecting from the pivot head 63. The guide element 76 performs an appropriate motion apparent from FIGS. 3, 5 and 6 by the described pivoting and displacement of the pivotable lever 45 and can be used for the desired length compensation of the length of the strand 37. The guide element 76 is formed e.g. as a guide roller and corresponds to the guide roller 41 in FIG. 2.

According to an especially preferred embodiment of the invention the compensating device has two additional guide elements 77 and 78 attached to the pivot head 63, similarly formed as guide rollers for the strand 37. These additional guiding elements 77 and 78 are each mounted by means of an angular lever 79 or 80 or the like on the front side of the plate 68 and attached by means of the screws 69 to the pivot head 63. As is especially apparent from FIGS. 3 and 4, the first additional guide element 78 has an entrance opening 81 for the strand advantageously exactly on the pivot axis 74, which continuously maintains its position independently of the momentary pivot position of the pivotable lever 45 and because of that the given rotational position of the pivot head 63. Because of that a fixed input position for the strand 37 results independently of the pivot position of the pivotable lever 45. In contrast, a second additional guide element 77 is arranged with a predetermined spacing from the first additional guide element 78 and the pivot axis 74. This spacing depends, on the one hand, on the shape of the guide track 67 and, on the other hand, on the position of the guide element 76 attached to the pivotable lever 45. The strand 37 thus runs from the spool 38 first over the first additional guide element 78 and from there over the second additional guide element 77 and the main guide element 76 to the guide part 42. In so far as possible the arrangement is also designed so that the length changes of the sections of the strand 37 between the braiding point 35 and the associated spool 38 are at least partially compensated, when the pivoting lever 45 is pivoted back and forth between its position according to FIG. 5 and that of FIG. 6, i.e. the strand 37 is held substantially constantly stretched during these motions, without sagging or tearing.

The advantage of the arrangement described from FIGS. 3 to 6 is that it has a comparatively simple and approximately triangular guide track 67 and still can compensate for comparatively large length changes of e.g. 30 mm. When the primary guide element 76 and the additional guide elements 77 and 78 are employed only about 10 mm of a length change which is at most e.g. 40 mm must be compensated by an additional compensating device operating with the springs or the like elements according to the prior art, which can be attended to by one skilled in the art without more. Based on the foregoing, without more to adjust the positions of both the primary guide element 76 and the additional guide elements 77, 78 on the pivotable lever 45 or on the pivot head 63, on the one hand, and the shape of the guide track 67, on the other hand, so that a nearly 100 percent compensation of the length changes can be obtained by the described motions. The extent of the compensation desired with the desired positive guidance provided by the guide track 67 and the pivot head 63 or their guide rollers 73 and slide plates 72 depends primarily on the construction expenses in regard to the shape of the guide track 67 and if necessary the required bending or shape of the bent lever 79,80 and the dimensions of the remaining parts.

Figure 5:
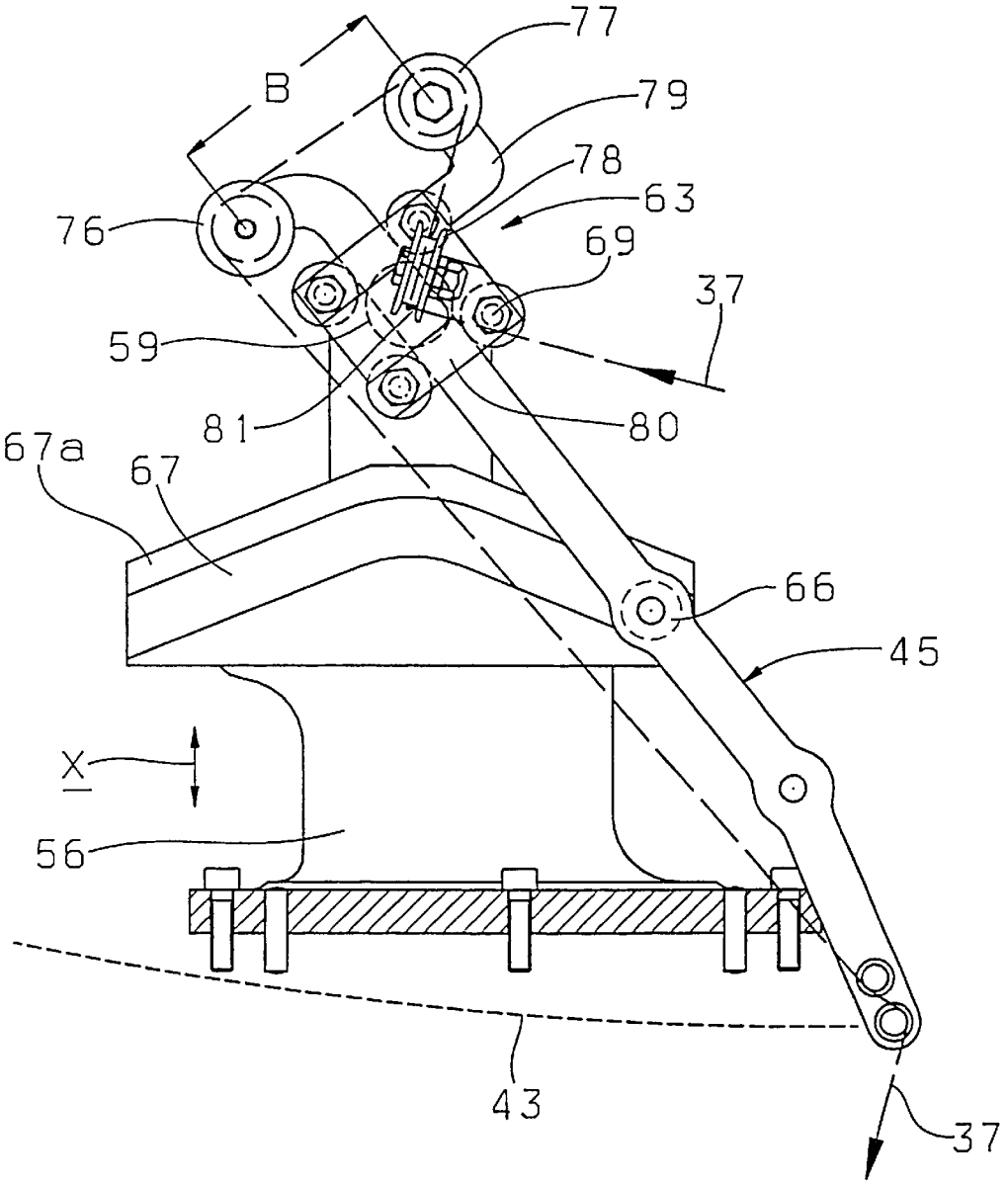
FIGS. 5 and 6 are respective front action views showing the compensating device according to FIG. 3 in two other operating positions.
Figure 6:
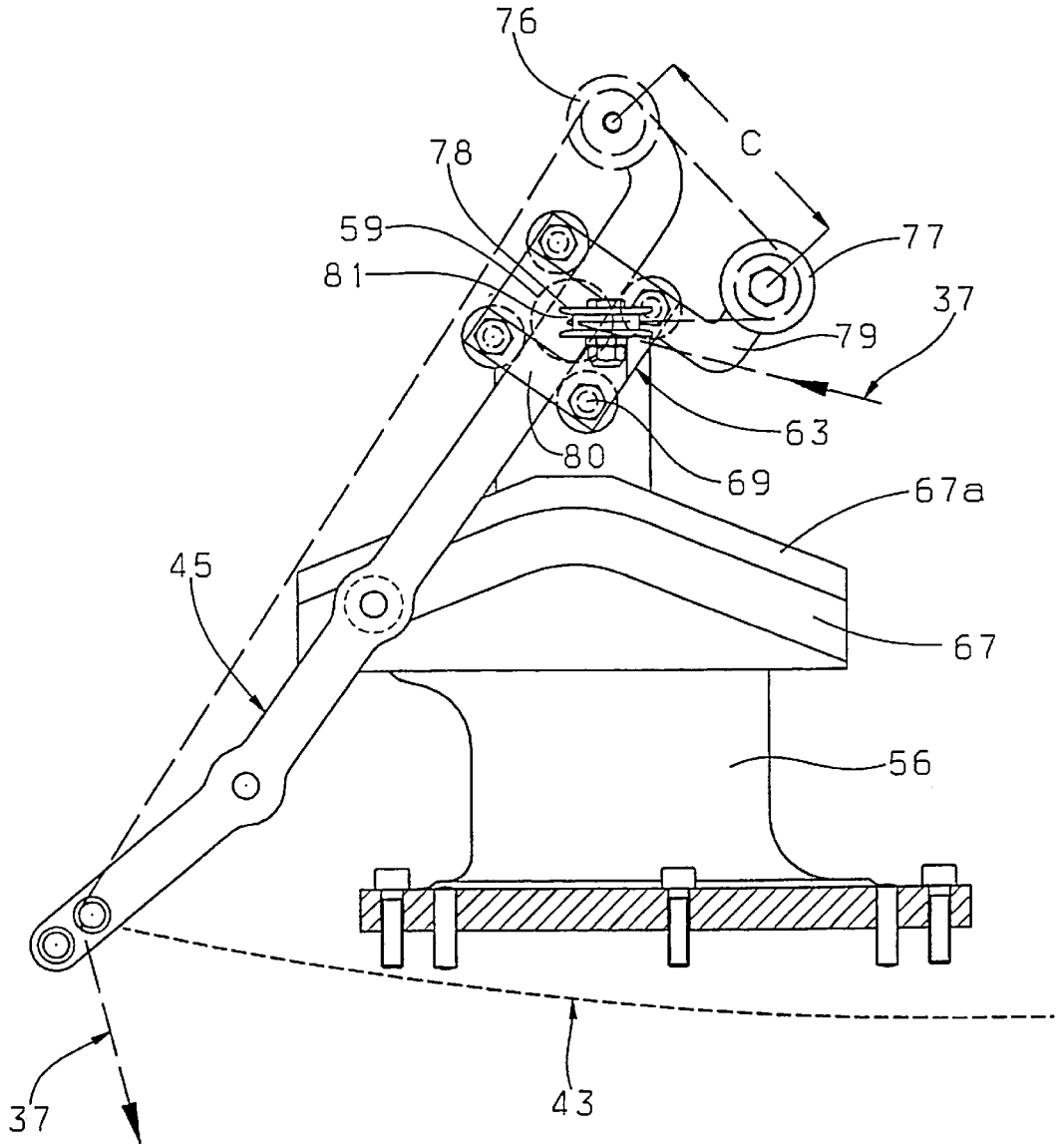

The compensation of the length changes of the strand 37 obtainable with this embodiment of the invention results substantially from the selection of the dimensions A, B and C according to FIGS. 3, 5 and 6, i.e. the spacing of the conducting member 76 and the second additional guide element 77 from each other in the different positions of the pivotable lever 45. While the dimensions B and C are substantially equal, the dimension A is larger than the dimensions B and C. Because of that a length reduction of the associated strand section is compensated, which results because the guide part 42 has a larger spacing from the braiding point 35 in the positions according to FIGS. 5 and 6 than in the position shown in FIG. 3. The dimension A is substantially greater than the dimension B or C for these length changes.

The length changes of the stands coming from the remaining eleven outer spools 38 of the circular braiding machine according to FIG. 1 are advantageously compensated in the same way.

The invention is limited to the described embodiment which can be varied in many ways within the scope of the invention. This is especially true for the shape of the guide track 67 and the motion of the pivotable lever 45 and primary guide element 76 and additional guide elements 77 and 78 resulting from that.

Furthermore it is not necessary to mount the additional guide elements 77 and 78 on the pivot head 63, since other, especially fixed, arrangements of one or more guide elements not on the pivotable lever 45 may be provided for the desired compensation, e.g. when the guide elements are mounted on the carrier 56. In principal, among others a single guide element can be sufficient, if it is not necessary to attach the guide element 76 and guide part 42 to a common pivotable lever. Furthermore it is possible to only pivot the pivotable lever as described without simultaneously sliding it. Furthermore it is clear that the described compensation can also be correspondingly employed when the inner spools 31 are pivotable instead of the outer spools 38 in order to execute or perform the required crossing. Finally it is understandable that the individual features can also be employed in other combinations than those shown and described in the drawing figures.

The disclosure in German Patent Application 198 53 869.3 of Nov. 23, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a circular braiding machine and strand guiding device for same, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A strand guiding device for a circular braiding machine, said circular braiding machine having a braiding point (35) and a first spool (38) for a first strand (37) fed to said braiding point (35), and said strand guiding device for strand guiding comprising a guide part or guide device (42) for said first strand arranged between said first spool (38) and said braiding point (35), said guide part or guide device being movable back and forth for crossing the first strand (37) over at least one second strand (32) coming from a respective second spool (31) so that a length of a section of the first strand (37) between the first spool and the braiding point (35) continuously changes, and a device for compensating changes in said length of said section, said device for compensating comprising at least one movable guide element (76) for the first strand (37) arranged between the first spool (38) and the guide part or guide device (42) and a positive guidance means (63,67) for moving the at least one movable guide element (76), whereby the changes in said length of said section of the first strand are at least partially compensated by motions of the at least one movable guide element.

2. The strand guiding device as defined in claim 1, wherein the means for compensating includes at least one additional guide element (78,77), the positive guidance means (63,67) includes a pivotable lever (45), the guide part or device (42) and the at least one movable guide element (76) are arranged on said pivotable lever (45), and at least one additional guide element (78,77) is not arranged on said pivotable lever (45).

3. The strand guiding device as defined in claim 2, wherein said positive guidance means (63,67) comprises a guide track (67) for a following element (66) attached to said pivotable lever (45) and engaged in said guide track (67).

4. The strand guiding device as defined in claim 2, further comprising a carrier (56) and wherein the positive guidance means includes a pivot head (63) rotatably mounted on said carrier (56), the pivotable lever (45) is slidably mounted in said pivot head (63) and the pivotable lever (45) is pivotable around said pivot head (63) about a common pivot axis (74).

5. The strand guiding device as defined in claim 4, wherein said at least one additional guide element (78,77) is mounted on said pivot head (63).

6. The strand guiding device as defined in claim 5, wherein said at least one additional guide element (78,77) consists of a first additional guide element (78) and a second additional guide element (77), one of said additional guide elements is provided with an entrance opening (81) for said first strand and said pivot axis (74) passes through said entrance opening (81).

7. The strand guiding device as defined in claim 5, wherein said pivot head (63) comprises four rotatable guide rollers (71) mounted therein and said pivotable lever (45) is slidably mounted between said guide rollers (71).

8. The strand guiding device as defined in claim 5, wherein said pivot head (63) comprises two slide plates (72) and said pivotable lever (45) is guided between said slide plates (72).

9. The strand guiding device as defined in claim 5, further comprising a push rod (46) articulated with said pivotable lever (45) to drive said pivotable lever (45) so that said guide part or device (42) is movable back and forth.

10. The strand guiding device as defined in claim 9, further comprising a crank element (48) pivotably connected with said push rod (46).

11. A circular braiding machine having a rotation axis (1) and comprising a group of inner spools and another group of outer spools, each of said spools carrying a single strand, each of said groups being arranged on a respective circular track coaxial to the rotation axis (1) and being movable in opposite circumferential directions around said tracks;

means for crossing the strands (32,37) of the inner and outer spools (31,38), wherein the means for crossing the strands (32,37) includes guide parts or devices (42) for guiding the respective strands (37) from one of said groups of said spools to a point between said spools of said one of said groups and a braiding point (35), whereby the guide parts or devices (42) are movable back and forth so that respective lengths of strand sections extending between the braiding point (35) and said spools of said one of said groups continuously change; and means for compensating for changes in the length of each of the strand sections, said means for compensating including at least one movable guide element (76) for the respective strands arranged between said spools of said one of said groups and the guide part or device (42) associated therewith and positive guidance means for moving the at least one movable guide element, whereby the length changes of the respective stands are at least partially compensated by motion of the at least one movable guide elements for the respective strands.

12. The circular braiding machine as defined in claim 11, wherein said means for compensating are arranged on said outer spools (38).

* * * * *